United States Patent [19]

George

[11] 4,108,118

[45] Aug. 22, 1978

[54] WATER JACKETED CYLINDER

[76] Inventor: Robert Jay George, 4248 Via Marina, Marina Del Rey, Calif. 90291

[21] Appl. No.: 748,951

[22] Filed: Dec. 9, 1976

[51] Int. Cl.[2] ..... F01P 3/02

[52] U.S. Cl. ..... 123/41.57; 123/41.18; 123/41.81

[58] Field of Search ..... 123/41.18, 41.57, 41.81, 123/41.8, 41.79

[56] References Cited

U.S. PATENT DOCUMENTS 605,405 6/1898 Davis ..... 123/41.81

843,068 2/1907 Brady ..... 123/41.81

1,725,121 8/1929 Wintercorn ..... 123/41.18

FOREIGN PATENT DOCUMENTS 1,027,810 4/1966 United Kingdom ..... 123/41.57

*Primary Examiner*—Robert G. Nilson

*Attorney, Agent, or Firm*—Georges A. Maxwell

[57] ABSTRACT

A water jacketed replacement cylinder assembly for air-cooled motorcycle engines including means to control and direct the flow of liquid coolant for most effective heat transfer at the normally hottest zone at the thrust side of the cylinder.

4 Claims, 8 Drawing Figures

WATER JACKETED CYLINDER

This invention has to do with a combination air and water cooled internal combustion engine and is more particularly concerned with a substitute or replacement cylinder with a related water jacket structure, for an air cooled cylinder of an air cooled engine.

In the motorcycle art, air cooled internal combustion engines are commonly provided and used. While air cooled motorcycle engines have proven to be quite satisfactory and dependable, there are certain shortcomings to be found in such engines. One shortcoming resides in the fact that such engines normally operate at a higher temperature than water cooled engines and, as a result of an anticipated expansion and contraction of parts (as the engines heat and cool) must be carefully assembled (when parts are cooled) to accommodate for anticipated relative expansion and contraction of parts. In spite of such compensatory efforts, such air cooled engines are notoriously subject to becoming loose or sloppy as a result of heating and cooling with resulting premature wear and reduced effective engine life.

Another shortcoming found to exist in air cooled motorcycle engines resides in the tendency for the temperatures at the thrust side of the cylinders to rapidly increase when the engines are operated under a load. The rate of the noted temperature increase and the amount of heat generated at the thrust side of the cylinders in such engines is frequently greater than the heat dissipating or radiating fins provided on and about the cylinder can keep up with or handle and is such that it is not uncommon that the thrust side of the cylinders and the piston and ring assemblies related thereto become overheated and are scorched, burned and/or otherwise so adversely affected as to result in the breakdown or destruction of the cylinders and/or piston and ring assemblies.

The noted thrust side of the cylinder of reciprocating cylinder and piston, internal combustion engines, is that side of the cylinders towards which the connecting rods, between the pistons and the engine cranks, are inclined upon the downward moving power stroke of the pistons. As a general rule, at one moment during each power stroke of a piston, in excess of 80% of the force generated by combustion of the fuel in the cylinder and acting upon the piston is imposed by the piston upon the cylinder wall. Further, that force is, as a general rule, imposed upon the cylinder wall about one-quarter of the distance down from the top of the stroke of the piston. Accordingly, the frictional heat generated at the thrust side of the cylinder of an engine is substantially concentrated at or within a relatively small, predetermined or known area of the cylinder, which area is sometimes called and which hereinafter will be referred to as the "hot spot" of the cylinder.

It has been determined that but for the deficiency or inability of air cooling means of air cooled motorcycle engines to cool the hot spots of cylinders when such engines are operated under high or extreme load conditions, air cooling of such engines is most effective and desirable. It has been further determined that if cooling of the noted hot spots of cylinders could be more effectively cooled, engine performance would be greatly improved. It has been further determined that such improved cooling might best be effected by circulation of a fluid transfer medium or water at or about the hot spot of such cylinders.

To the best of my knowledge and belief, internal combustion engines are either air-cooled or water-cooled. That is, if the engines are to be employed in a situation or in an environment where they can be air-cooled, cooling by air is employed exclusively; while in those situations where cooling by air is not feasible or desirable, water-cooling means are employed exclusively.

In accordance with the above, when and where air-cooling means are employed, the engine cylinder heads and cylinders or cylinder blocks are provided with heat transfer or radiating fins or the like to dissipate heat into the ambient atmosphere. Where and when water-cooling means are employed, the engine cylinder heads, cylinders or cylinder blocks are suitably water-jacketed and water or the suitable fluid heat transfer medium is employed, exclusively, to absorb and carry away the heat of the engine.

Air-cooling of engines is generally relied upon and utilized where and when engine weight and costs are sought to be maintained at a minimum. When water-cooling is required it has, as a general rule, been accepted as a total necessity and the attending increased weight and cost factors connected therewith are accepted and worked with, without question.

The utilizing of both air and water-cooling means wherein the cylinder heads are air-cooled and the cylinders are water-cooled is contrary to normal and generally accepted practices and is believed to be novel. In normal water-cooled engine design, the cylinders are arranged within cylinder blocks with water-conducting passages or cavities which extend about the cylinders or portions of the block in which the cylinders are arranged. The water or coolant is introduced at one end or location in the block and is caused to flow about the block and about the cylinders in a rather general or random manner. There is no particular or special attention or special means provided or employed whereby cooling of the hot spots of the cylinders are cooled in a manner different from any other parts or portions of the cylinders. In the ordinary water-cooled engine, the mass of the block in which the cylinders are arranged is utilized as a general heat sink and the water is utilized, generally, to absorb the heat from the general mass of the block and to carry that heat away for disposal, as by means of a radiator.

An object and feature of my invention is to provide a novel and improved internal combustion engine having water-jacketed cylinders and air-cooled cylinder heads, wherein the engine cylinders are cooled to an extent and in a manner similar to that in which the cylinders of a water-cooled engine are cooled, but with or by means of a water-cooling system and/or structure which is a small fraction of the size, weight and cost of the water-cooling system and/or means normally associated with water-cooled internal combustion engine of like size and capacity.

It is an object and feature of this invention to provide an improved water-cooling means for the cylinders of air-cooled engines whereby the cylinder can be more effectively and efficiently cooled and the problems normally associated with the over-heating of cylinder in such engines can be avoided.

Another object of my invention is to provide novel water-cooled or jacketed replacement cylinders for air-cooled cylinders of motorcycle engines.

Yet another object of my invention is to provide a novel sectional water-jacketed structure for engagement about a related cylinder.

Still further, it is an object and feature of my invention to provide a novel water-jacketed structure for a cylinder of an internal combustion engine whereby cooling water is first directed to and across the thrust side of and/or hot spot of the cylinder, whereby the water is most effectively and efficiently utilized to cool the cylinder.

An object of this invention is to provide a water-jacketed structure of the character referred to having novel means for controlling the flow of water into and out of the jacket and which utilizes vortex flow to maintain desired water circulation and to counter convection currents which tend to interfere with desired flow.

The foregoing and other objects and features of my invention will be fully understood and will become apparent from the following detailed description of typical preferred forms and application invention throughout which description reference is made to the accompanying drawings, in which.

Figure 1:
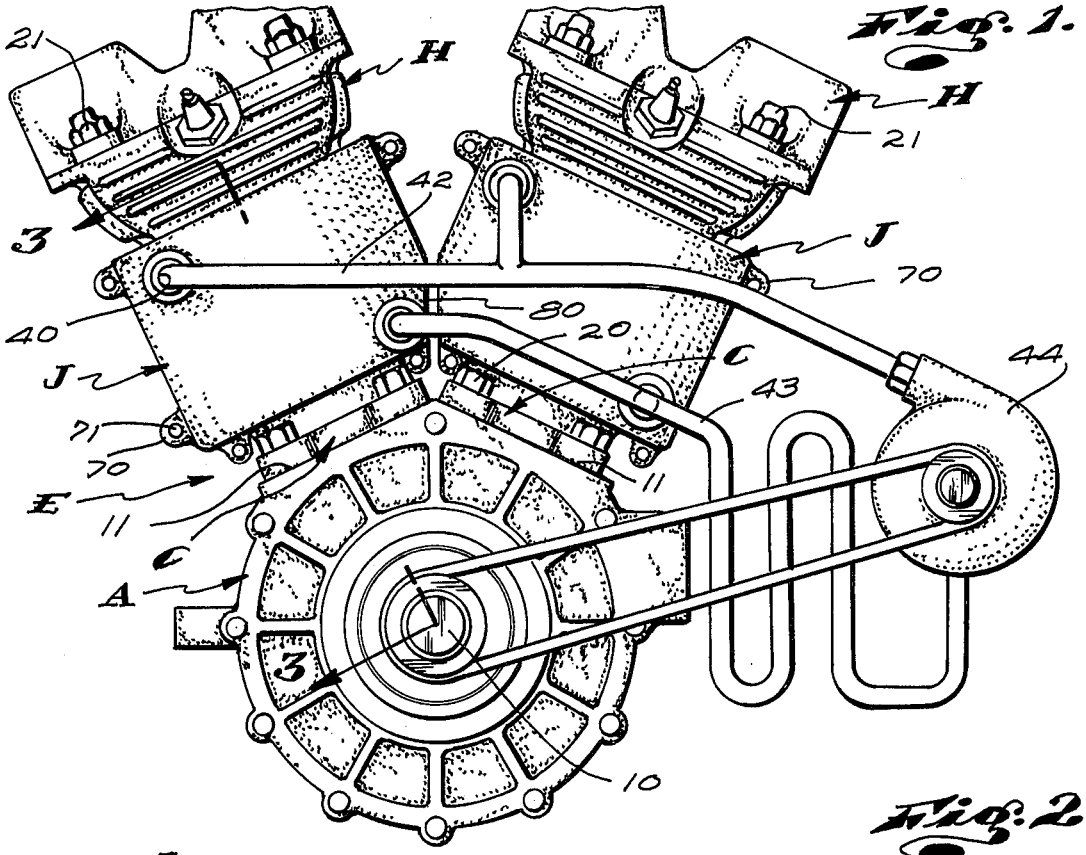
FIG. 1 is an elevational view of a typical two-cylinder air-cooled engine with the water jacketed cylinders that I provide related thereto.
Figure 2:
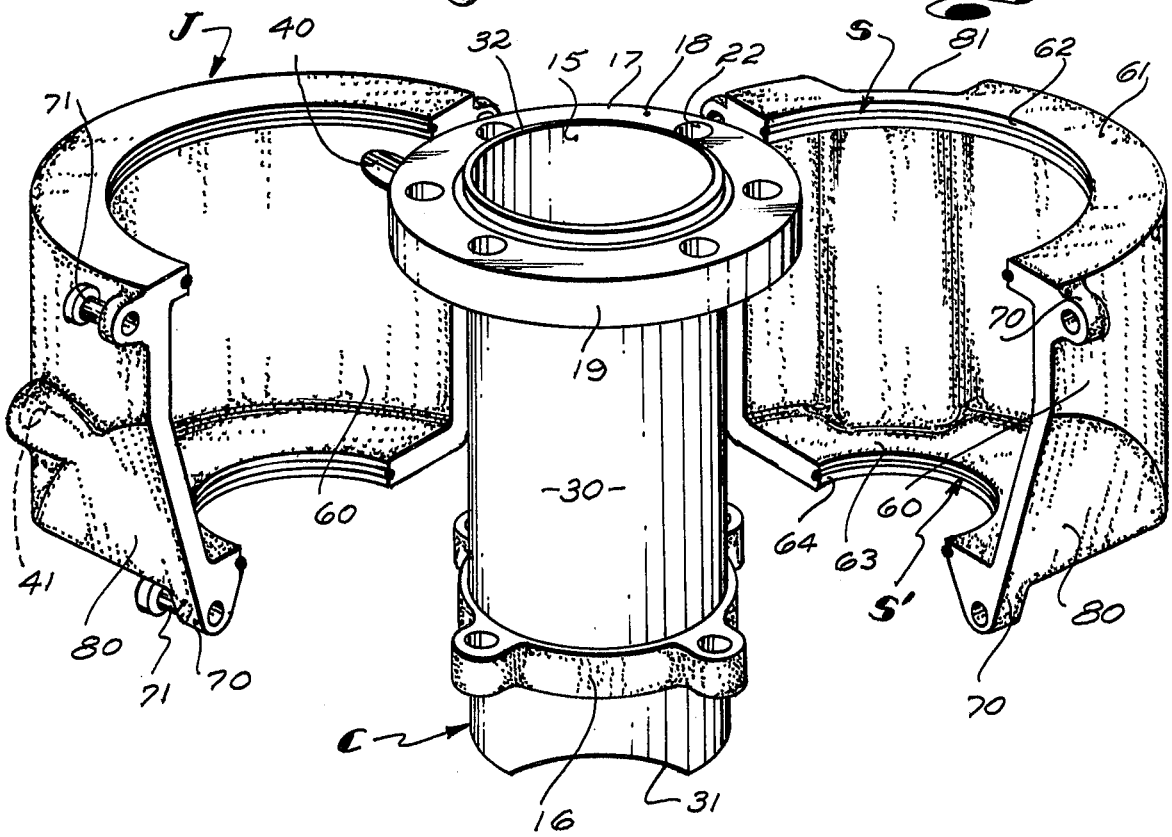
FIG. 2 is an exploded isometric view of a cylinder and jacket structure provided by this invention.
Figure 3:
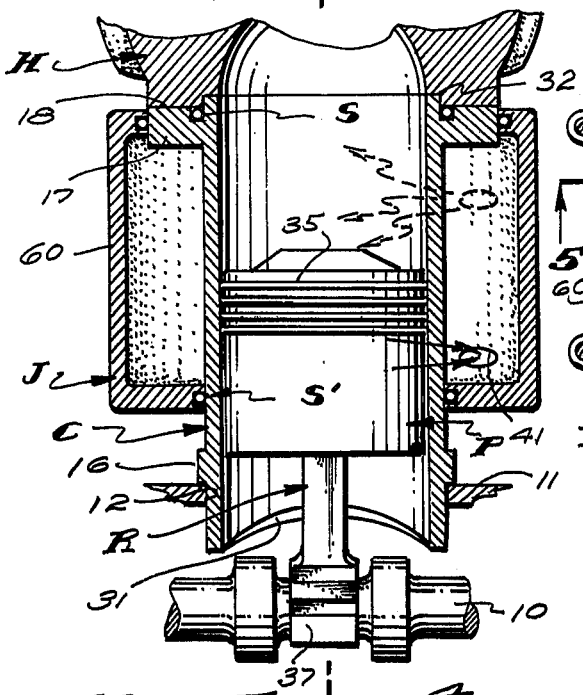
FIG. 3 is a detailed sectional view of the cylinder and jacket structure taken as indicated by line 3—3 on FIG. 1.
Figure 4:
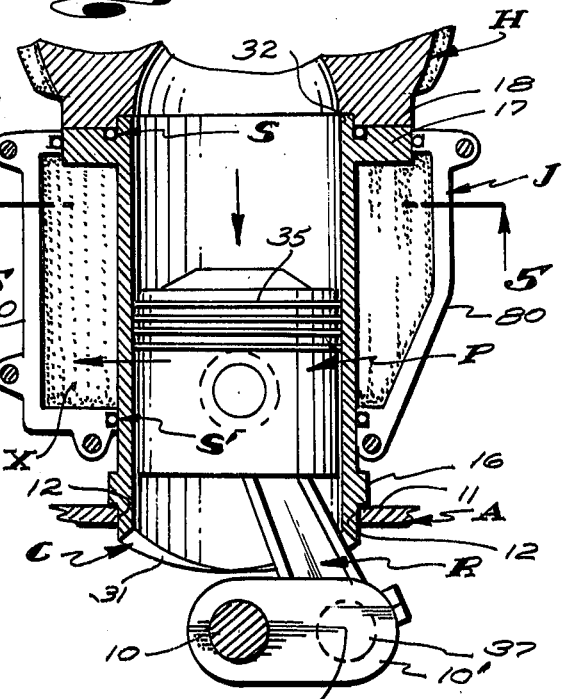
FIG.4 is a sectional view taken as indicated by line 4—4 on FIG. 3.
Figure 5:
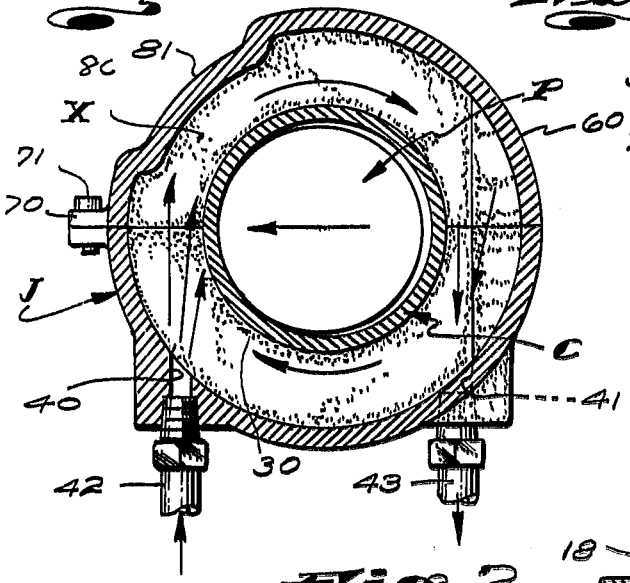
FIG. 5 is a sectional view taken as indicated by line 5—5 on FIG. 4.

In FIG. 1 of the drawings, I have illustrated a typical motorcycle engine E.

The engine E includes a crankcase A, a pair of like cylinders C carried by the crankcase and head H related to the cylinders.

In addition to the foregoing, the engine E in accordance with common practice includes valving means in the heads H, ignition means, which means includes spark plugs in the heads, a distributor, coil, wires and the like; fuel supply means, which means includes an intake manifold, carburator and the like; and exhaust means, which means includes an exhaust manifold and related hardware.

Since the above noted means are common means well-known in the art and can vary widely in form and since those means in no way alter or affect the present invention, I have elected not to burden this dislosure with detailed illustration and description thereof.

The crankcase C comprises a metal housing in which a crankshaft 10 is bearing supported. The crankcase C is characterized by substantially upwardly disposed, angularly related, flat cylinder mounting pads or surfaces 11 with openings 12 to accommodate and communicate with related cylinders.

The cylinders C are elongate substantially vertically extending units with central upwardly and downwardly opening bores 15. The lower end portions of the cylinders are provided with radially outwardly disposed mounting flanges 16 to engage the crankcase pads 11 with which they are related. The upper ends of the cylinders are provided with radially outwardly projecting cylinder head mounting flanges 17 with flat top surfaces 18 and straight cylindrical outside surfaces 19.

The cylinders C are releasably secured to the crankcase A by suitable screw fasteners 20 engaged through the flanges 16 and into the case.

In the particular cylinder structure illustrated, the cylinder flanges 16 are interrupted or relieved circumferentially so as to define what is in essence, four circumferentially spaced radially outwardly projecting apertured fastener receiving ears or the like.

The cylinder heads H related to the cylinders C are standard or conventional air-cooled motorcycle cylinder heads adapted to close the upper ends of the cylinders C and are secured to the top surfaces 18 of the flanges 17 of the cylinders by a plurality of head bolts 21 engaged through the heads and into registering openings 22 in the flanges 17, substantially as indicated in the drawings.

It is to be understood that the heads H, in accordance with common practice, are provided with or carry the valving means for engine and that the fuel supply means, ignition means and exhaust means, for the engine (none of which means has been illustrated) are directly related thereto.

The cylinders or cylinder units C provided by the present invention are substantially alike and each comprises an elongate substantially vertically extending unitary cast steel alloy (or cast iron) tubular body 30 defining the aforementioned outwardly and downwardly opening bore 15 and on or with which the lower case engaging flange 16 and upper head engaging flange 17 are integrally formed.

In accordance with common practice, the lower end portion of the cylinder projects downwardly below the flange 16 to project through its related opening 12 in the case A, into the case and is suitably relieved as at 31 to accommodate the crankshaft and the connecting rod of the engine which are related thereto. In practice, and as illustrated in the drawings, the upper end of the cylinder is provided with a head engaging annular orienting lip which projects above the top surface 18 of the flange 17 and is further provided with an annular groove, in the surface 18 and about the lip to receive an O-ring seal.

While in the case illustrated, the cylinders C are inclined approximately 25° from normal or vertical, for the purpose of this disclosure, the cylinders will be described as being vertical.

The central longitudinal axis of the cylinders is substantially normal to the axis of the crankshaft 10 and slidably accommodate pistons P which pistons are provided with and carry bore engaging rings 35.

Each piston P is connected with the crankshaft 10 by the connecting rod R, which has an upper end pivotally bearing coupled with the piston P as at 36 and has its other or lower end rotatably bearing connected with a related crank portion 10' of the crankshaft 10, as at 37. The piston P is adapted to reciprocate or shift outwardly and downwardly in the cylinder bore 15 between upper and lower positions. As the piston reciprocates in the cylinder, the crank is rotated by means of the connecting rod R. The rod R is in substantial axial alignment with the cylinder bore when the piston is in its upper and lowermost positions and its lower end shifts radially relative to the axes of the bore and shaft, out of alignment therewith as when the piston is moved to and from or between said upper and lowermost positions.

When the piston P moves downwardly in the cylinder, the rod is angularly related to the axis of the cylinder bore and the axis of said rod extends to one side of the central rotative axis of the shaft 10. The angle of the rod increases progressively until the piston is in its central position in the cylinder bore and then decreases progressively until the piston reaches its lowermost position. Upon reaching its lowermost position, the piston commences to move upwardly in the cylinder bore and the axis of the rod shifts over center to the other side of the rotative axis of the shaft 10 to become angularly related to the axis of the cylinder bore to a progressively greater extent until the piston reaches its central position, whereupon the angularity of the rod decreases until the piston reaches its uppermost position once again. As soon as the piston reaches its uppermost position, the above described cycling is repeated.

In the case of two cycle engines, upon commencement of each downward movement of th pistons in the cylinders, charges of fuel and air in the cylinders, between the top of the pistons and the heads, are ignited and the expanding gases of combustion drive and urge the pistons downwardly in the cylinders. This above noted combustion, downward movement of the pistons and resulting movement or travel of the rod and crank is referred to as a power stroke.

In the case of four cycle engines, a power stroke occurs upon every other downward movement of the pistons in the cylinders.

On each power stroke of a cylinder and piston engine such as here provided, the forces of the expanding gases of combustion are directed through the piston to the rod and thence to the crankshaft. Due to the above noted misalignment of the rods to the axes of the cylinder bores, as the pistons move downwardly, a reactive lateral force is generated, which force urges the pistons towards and into pressure bearing engagement with the sides of the cylinders (or the bores thereof) towards which the upper ends of the rods are inclined. Those sides of the cylinders towards which the pistons are urged, as above noted, are referred to as the thrust sides of the cylinders. The reactive lateral forces between the cylinders and bores increases progressively as the angle of inclination of the rods increase and would, theoretically, reach their maximum when the pistons reach the middle of their strokes. In practice, however, the principle or greatest forces of the expanding gases of combustion may be generated when the pistons have moved down about one-quarter of their stroke and said forces commence to diminish when the pistons reach the middle of their strokes. Accordingly, the greatest lateral forces might occur at the thrust sides of the cylinders in the upper quarter portions thereof. The lateral forces referred to result in increased friction between the pistons and the cylinders and the generating of greater heat in the affected area of the cylinders, which are is referred as the "hot spot". The heat generated between the pistons and cylinders at the "hot spots" of the cylinders is oftentimes sufficient to burn and destroy the pistons and the rings carried thereby and to result in the burning and scoring of the cylinder bores, with resulting destruction of the engines.

In the case of air-cooled cylinders provided with outwardly projecting heat radiating cooling fins, the heat radiating fins are frequently inadequate to dispose of the heat generated at the hot spots of the cylinders when the engines with which the cylinders are related are subjected to heavy work loading. Accordingly, such air cooled cylinder structures are notoriously subject to overheating with all of its adverse effects. Further, the heat radiating fins of such cylinders do not provide for a uniform or controlled cooling of the cylinders with the result that the areas of the cylinders and related engine parts about the hot spots of the cylinders are generally considerably hotter and expand or grow to a greater extent than other parts and/or portions of the engine structure. As a result of the above, the tolerances between the parts of the engine are subject to great and oftentimes extreme non-uniform change during operation of the engines. Such changes greatly impede the ability to accurately and dependably assemble an air cooled engine in a most effective and efficient, predetermined manner.

Referring again to the cylinder structure or cylinder units C that I provide, each structure or unit includes a water jacket J engaged about the cylinder body 30, between the flanges 16 and 17 thereof and which cooperates with the cylinder body to define an annular water conducting chamber X which extends throughout the major longitudinal extent of the cylinder. The jacket structure J is provided with the water inlet port 40 and a water outlet port 41 which ports are connected with water supply and return hoses or lines 42 and 43. The lines 42 and 43 extend to and are connected with a suitable recirculating pump 44.

In practice, the pump 44 can, for example, be a simple centrifugal pump driven from any desired rotation shaft of the engine or other running gear related to the engine.

The pump can be run from the shaft 10 substantially as illustrated in FIG. 1 of the drawings or can, if desired, be driven by an electric motor or other power source independent of the engine, without departing from the spirit of my invention.

In actual reduction to practice, it has been determined that in many instances, the jacket structures J and the lines 42 nd 43 can effect sufficient heat exchange with the ambient atmosphere so that a radiator is not required. In such cases, a low capacity recirculating pump means in combination with the jacket structures and the fluid conducting lines whereby desired circulation of water is maintained, has proven both practical and effective.

It is notably and particularly advantageous that the cool water flowing or conducted into the chambers X defined by the jackets and cylinders be introduced into those portions of the chambers adjacent to the hot spots of the cylinders and that the water be directed to flush or flow directly across said hot spots where the greatest amount of heat to be conducted away is generated. To the above end, the inlet ports 40 are preferably located in the upper quarter portions of the jacket structures in the area of the thrust side of the cylinders and with their inner open ends disposed towards the area of the cylinders wherein the hot spots occur.

So as to assure desired flow of the cool water entering the chamber across the hot spot and to avoid generation of turbulence which would impede such flow of the water, the inlet port 40 is preferably located circumferentially and/or to one side of the hot spot and on an axis which is substantially tangent with the cylinder body at the hot spot thereof. Further, so as to assure desired and controlled flow of water in the annular chamber X about the cylinder body 30, the outlet port 41 is preferably arranged or located in the lower portion of the jacket and is on an axis substantially tangent to and with its inner open end opposing the direction of circular flow of the water established in the chamber by the inlet port 40.

In practice, the outlet port 41 can be in the upper portion of the jacket circumferentially spaced from the inlet port 40 and to occur at the side of the hot spot remote from the side of said hot spot toward which the inlet port 40 is directed whereby the water is drawn or pumped from within the chamber in such a manner that the cool water introduced or pumped into the chamber establishes a basic or primary flow pattern across said hot spot of the cylinder.

In furtherance of my invention, when the outlet port 41 is in the lower portion of the jacket, and is spaced below the inlet port, the inlet port is arranged or positioned so that the circular flow of water in the chamber X is in a clockwise direction, whereby a vortex flow of water is established in the chamber and about the cylinder, between the inlet and outlet ports.

Such a vortex flow assists in the establishing and maintaining of the desired flow of water about and down through the chamber and serves to counteract the establishing of heat convection currents in the water within the chamber which currents might interfere with the most effective and efficient circulation of water.

The cylinder and jacket structure that I have illustrated in the drawings is that general form of structure which is suitable for substitution or replacement of a standard air-cooled cylinder of a Harley-Davidson motorcycle engine. The jacket chain is a split, two-piece, sectional structure of cast allumininum alloy defining a substantially circular or cylindrical side wall 60 which is arranged or occurs in radial outward spaced relationship with the portion of the cylinder body 30 above the lower flange 16, a substantially flat top wall 61 with a central cylinder hole opening 62 in which the upper or top flange 17 of the cylinder is tightly engaged and a substantially flat bottom wall 63 with a central cylindrical opening 64 in which the cylinder body, above the lower flange 16, is tightly engaged. The openings 62 and 63 are provided with sealing means S and S' to seal with and about their related flange 17 and cylinder body 30. The sealing means S and S' prefereably include radially inwardly opening O-ring grooves in the openings 62 and 64 and silicone O-rings in the grooves to engage their related portions of the cylinder structure.

The jacket is divided or split on a central vertical plane to define two radially inwardly opening semi-circular channel like sections with flat vertical edges on said central vertical plane. Each of the said edges of each section establishes flat bearing engagement with a related edge of the other section when the jacket is engaged and assembled with and about the cylinder C and the planes of joinder between the sections are sealed by means of a suitable cement.

The sections of the jacket are provided with outwardly projecting, opposing, related screw-fastener receiving ears 70 at their vertical edges to cooperatively receive screw-fastening means 71, in the form of clamp screws, to secure the sections of the jacket in tight sealed and clamped engagement with each other and about the cylinder.

The lower or bottom wall 63 of the jacket structure is spaced a sufficient distance above the lower mounting flange 16 to accommodate the heads of the fasteners 20 provided to secure the cylinder to the crankcase C.

With the split jacket structure that I provide, it will be noted that the cylinder C can be first mounted on the crankcase in a most convenient manner and that the jackets J can thereafter be easily and conveniently related to the cylinder. It will be further noted that the upper walls 61 of the jacket are below and in non-interferring relationship with the head H mounted on and with the upper ends of the cylinder.

In practice, the size and volumetric extent or capacity of the jackets J can be made substantial and the sides and/or end walls of the jacket structure can be relieved and formed so as to accommodate and provide necessary clearances with and between related engine parts and/or structure. In the case illustrated, the jacket structures J that I provide have flat radially outwardly and upwardly inclined relieved portions 80 at one side thereof and adjacent the lower ends thereof to provide that clearance which is necessary to enable the two jackets to be effectively engaged with and about the two related and relatively inclined cylinders C of the engine E, without interferring one with the other. Further, the side and end walls of the jackets can, as illustrated, be provided with vertically extending relieved portions 81 at one side thereof to accommodate the valve operating push rods of the engine which extend between the crankcase and the heads H, at the exterior of the cylinders.

It will be apparent from the foregoing that in practice, the exterior configuration of the jackets J can be varied widely to adapt the jacket structure for varied and different installations without departing from the spirit of my invention.

Figure 6:
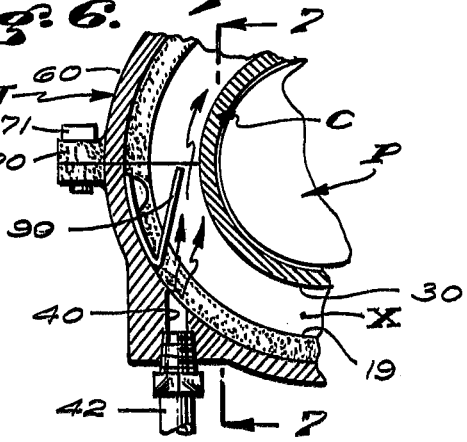
FIG. 6 is a view of a portion of a modified form of my invention.
Figure 7:
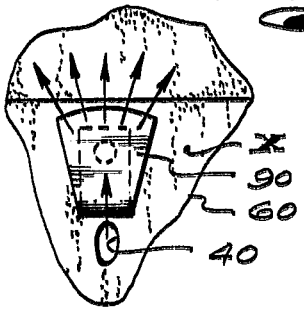
FIG. 7 is a view taken as indicated by line 7—7 on FIG. 6.

In FIGS. 6 and 7 of the drawings, I have shown another form of my invention which includes a flow deflector vane 90 fixed to the interior of the side wall 60 of the jacket, adjacent the inlet port 40 and which serves to deflect and direct the inflowing water across the hot spot of the cylinder.

Figure 8:
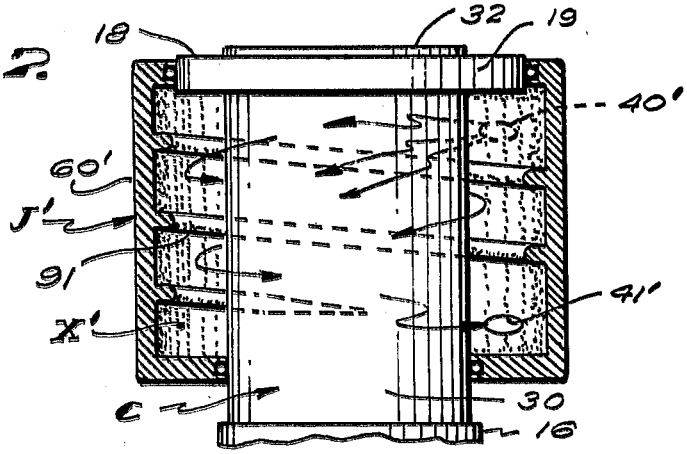
FIG. 8 is a view of yet another form of my invention.

In FIG. 8 of the drawings, I have shown yet another form of my invention wherein the radially inwardly disposed inside surface of the side wall 60' of the jacket J' is provided with a helical flow directing rib or vane 91 which serves to direct and control the flow of water in the chamber X' in a downwardly advancing circular pattern from the upper inlet port 40' to the lower outlet port 41'.

In practice, if desired, the jacket J' shown in FIG. 8 of the drawings could be provided with a deflector vane such as is shown in FIGS. 6 and 7 of the drawings, without departing from the spirit of my invention.

In practice, and as illustrated in FIG. 1 of the drawings, the water from the pump 44 is caused to flow directly to each cylinder unit C and the conducting of heated water from one cylinder unit to the next is avoided. By the aforementioned flow of water, both cylinder units are cooled in the same or similar manner and one is not sought to be cooled with water which is at a different temperature than the other.

While it is preferred that the water be supplied to related jacket structures, as above noted, notable and satisfactory success has been attained where or when the jackets are series connected. That is, where the water is conducted directly from one to the other of the cylinders.

Further, while it is preferred that the water flowing into the jackets be first directed across the hot spots of the cylinders, as above noted, notable and satisfactory results and success has been attained when the direction of flow in the chambers of the jackets is reversed and where no special effort is made to establish the aforementioned preferred flow or circulation of water. The success of the above noted departures from the preferred carrying out of my invention are attributable in part or to a great extent on the fact that the exterior surface area of the jacket structures and the volumetric extent of said structures, that is, the volume of water they hold, has been excessive or greater than necessary and such that the end to be gained by the noted and preferred controlled flow of water into and through the structure is diminished and/or rendered non-critical.

While the above is true, in practice, establishment and maintenance of the preferred flow of water in and through the structure that I provide enables the size of the jackets and the volume of water require for effective cooling to be reduced substantially. Such reduction in size of the jackets and of the volume of water required results in a material reduction in weight and costs and in the case of some air-cooled engines, can be a major factor in making possible the establishment and provision of a replacement water jacketed cylinder in accordance with the broad or basic idea of means of my invention.

Having described only typical preferred forms and applications of my invention, I do not wish to be limited to specific details herein set forth, but wish to reserve to myself any modifications and/or variations that may appear to those skilled in the art to which this invention pertains and which fall within the scope of the following claims:

Having described my invention, I claim:

1. A reciprocating cylinder and piston internal combustion engine comprising a crank case, a crank shaft rotatably carried by the case on a horizontal axis, a cylinder unit including an elongate tubular cylindrical body defining a central upwardly and downwardly opening bore, means mounting the body on the case to project substantially vertically and upwardly therefrom with its lower end communicating with the interior of the case, an air-cooled head structure with fuel supply, ignition and gas exhaust means positioned at and closing the upper end of the bore, means securing the head to the body, a piston and ring assembly slidably engaged in the bore and a connecting rod pivotally and rotatably connected with and extending between the piston assembly and the crank shaft, said cylinder unit including a jacket structure with a cylindrical side wall in radial outward spaced relationship about the body and having upper and lower ends in sealed engagement with the body below the head and above the case, said jacket and body defining an annular longitudinally extending chamber about the body, a water inlet port in the jacket, a water outlet port in the jacket spaced from the inlet port, a re-circulating pump with an inlet and an outlet, a fluid conducting delivery line from the pump outlet to the inlet port, a fluid conducting return line from the outlet port to the pump inlet and a volume of heat transfer fluid in the chamber, pump and lines; said body has a hot spot at its upper portion and at one side thereof where the piston assembly is urged to generate friction heat upon each downward power stroke of the piston in the cylinder, said inlet port being positioned in the jacket and disposed to direct fluid flowing therethrough and into said chamber toward and across the said hot spot.

2. A structure as set forth in claim 1 which further includes a flow deflecting vane in the chamber adjacent the inlet port to direct the flow of fluid in the chamber in a predetermined manner across said hot spot on the body.

3. A structure as set forth in claim 1 wherein in the inlet port is spaced circumferentially from, in a substantial common radial plane with, and is disposed substantially tangential with the said hot spot.

4. A structure as set forth in claim 3 wherein the inlet port is disposed to direct said fluid in a clockwise circular flow in the chamber and said outlet port is spaced below the inlet port whereby the fluid flows circularly and downwardly in and through the chamber in a vortex flow pattern.

* * * * *